United States Patent [19]

Kolb

[11] Patent Number: 4,557,077

[45] Date of Patent: Dec. 10, 1985

[54] OPTICAL PROJECTION PROFILE-GRINDING MACHINE

[76] Inventor: Alfred Kolb, Haus am Tannenberg, D-6980 Wertheim, Fed. Rep. of Germany

[21] Appl. No.: 691,441

[22] Filed: Jan. 14, 1985

Related U.S. Application Data

[63] Continuation of Ser. No. 465,607, Feb. 10, 1983, abandoned.

[30] Foreign Application Priority Data

Feb. 27, 1982 [DE] Fed. Rep. of Germany ..... 3207107

[51] Int. Cl.[4] ..... B24B 49/12

[52] U.S. Cl. ..... 51/165.72; 51/165.71

[58] Field of Search ..... 51/165 B, 165.7 B, 105 R, 51/165.71

[56] References Cited

U.S. PATENT DOCUMENTS 2,360,772 10/1944 Hedin .
2,446,575 8/1948 Cooke .
2,499,178 2/1950 Berry et al. .
2,729,036 1/1956 Franke et al. .
4,167,082 9/1979 Kolb .

FOREIGN PATENT DOCUMENTS 1139769 11/1962 Fed. Rep. of Germany .
2654404 6/1978 Fed. Rep. of Germany .

*Primary Examiner*—Harold D. Whitehead
*Attorney, Agent, or Firm*—Kenway & Jenney

[57] ABSTRACT

An optical projection profile-grinding machine with a workpiece holder that accepts the workpiece to be machined, a grinding wheel that may be positioned in relation to the workpiece, a projector for displaying an enlarged image of the point of engagement between the workpiece and grinding wheel on a projection screen, and a nominal profile line arranged on the projection screen, characterized by the workpiece being capable of rotation around the optical axis of the projector and of fixation in different angular positions in unison with the projection screen and its nominal profile line. The projection screen, or a carrier screen that accepts a nominal profile line and is arranged on the projection screen, is rotatable around the optical axis of the projector, in synchrony and at the same angular velocity as the workpiece.

4 Claims, 2 Drawing Figures

OPTICAL PROJECTION PROFILE-GRINDING MACHINE

This is a continuation of application Ser. No. 465,607, filed Feb. 10, 1983, now abandoned.

BACKGROUND OF THE INVENTION

When workpieces with closed curves are to be ground, until now the workpieces have been ground by area and then rechucked in a different position in a workpiece holder. For every subsequent indexing position another nominal profile segment is laid on the projection screen, care being taken that the workpiece is reindexed in such a manner that its image is brought into correspondence with the nominal profile line laid on the projection screen. A prerequisite for the latter condition is that the nominal profile lines be drawn on the nominal profile drawing in the position of the subsequent indexing in such a manner that they always lie contiguous to one another as a result of reindexing of the workpiece.

This procedure is extraordinarily time-consuming, and it also entails the risk of errors arising due to rechucking.

The invention is based on the problem of improving a projection profile-grinding machine of this type in such a way that even closed curves may be ground into workpieces with little expense and great precision.

This problem is solved according to the invention in an optical projection profile-grinding machine of the type described at the outset by means of the features of the workpiece and the projection screen with its nominal profile line being capable of rotation about the optical axis of the projector, fixation in different angular positions, and rotation in synchrony and at the same angular velocity.

Thus, according to the mechanism, both the workpiece and the projection screen and nominal profile line carrier are arranged such that they rotate about the optical axis of the projector, and both workpiece and nominal profile line are rotated in synchronism at the same angular velocity.

The rotation can occur in large intervals, so that one area of the workpiece is ground at a time and when this area is finished workpiece and nominal profile line are rotated by a certain angle so that thereupon a new area can be machined.

It is also possible to carry out the rotation in very small steps that follow one another in quick succession. This is advantageous, for example, when a body is to be ground into a circular cylindrical form with a grinding wheel executing an oscillating stroke movement parallel to the optical axis. This method of operation ensures that the grinding wheel is always introduced to the workpiece in a radial direction.

This method of operation is particularly advantageous when conical grinding of the workpiece is desired. The latter may be achieved simply with this method of operation by effecting the oscillating stroke motion of the grinding wheel not exactly parallel to the optical axis of the projector, but at an angle corresponding to the desired conical form.

By way of example, slight rotation of the workpiece and nominal profile line can be executed after each stroke of the grinding wheel in a grinding process, the distance of the grinding wheel carrier from the optical axis remaining constant throughout the entire rotation.

It is advantageous for the rotational drive for the workpiece and the rotational drive for the projection screen and the carrier to be coupled to each other by gearing. In this way synchronous rotation of the workpiece and the nominal profile line at the same angular velocity is ensured in a simple manner.

It is particularly advantageous for the rotational drives for the workpiece and the projector and carrier to consist of servomotors which are actuated in synchronism by a numerical control system. This numerical control system can simultaneously control the delivery of the grinding wheel in the direction toward the workpiece, so that, in all, fully automatic machining is ensured, which may be followed on the projection screen.

BRIEF DESCRIPTION OF THE DRAWINGS

The following description of preferred embodiments of the invention will serve in connection with the illustration to more fully explain the invention. Shown are.

DETAILED DESCRIPTION OF THE INVENTION

Figure 1:
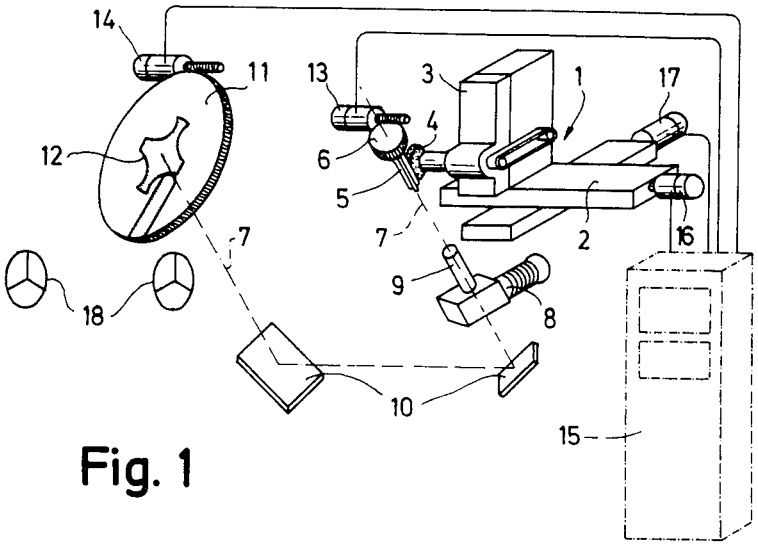
FIG. 1 a schematic representation of the basic parts of an optical projection profile-grinding machine with workpiece rotating about its optical axis and projection screen rotating about its optical axis, and FIG. 2 a partial view of a modified embodiment of an optical projection profile-grinding machine with transmitted-light projection and altered workpiece holder.

The projection profile-grinding machine represented only schematically in FIG. 1 includes a compound table 1, whose upper table 2 accommodates a grinding wheel holder 3. Mounted on the latter is a rotating grinding wheel 4.

A workpiece 5 to be machined is attached on one side to a workpiece holder 6, which is mounted in a rotating manner not apparent from the illustration on a machine frame which also accommodates compound table 1. The rotational axis of workpiece holder 6 coincides with the optical axis 7 of a projector, which comprises a light source 8 that illuminates the end face of workpiece 5, a lens 9, several deviation mirrors 10, and a projection screen 11. This projector images the point of engagement of workpiece 5 with grinding wheel 4 on projection screen 11. On the latter is arranged a nominal profile line 12, which superimposes the desired workpiece contour in an enlarged scale corresponding to the enlargement effected by the projector. The nominal profile may be drawn, e.g., on a transparent carrier which is laid on projection screen 11.

According to the invention, projection screen 11 together with nominal profile line 12 arranged on the latter is mounted on the machine frame in such a manner that it rotates about the optical axis 7 of the projector.

The rotation of workpiece 5 and projector screen 11 is brought about in synchronism and at the same angular velocity by suitable means, for example, by appropriate gearing which couples the rotational drives of the two elements together. In the embodiment illustrated in FIG. 1, the rotational drives are formed by servomotors 13 and 14, which rotate the workpiece holder and workpiece, on one hand, and the projection screen and nominal profile line, on the other, by means of gearing (worm and toothed ring). Actuation of these two servomotors is effected in synchronism and in such a way that workpiece and nominal profile line are rotated at the same angular velocity. They may be actuated, for example, by a numerical control system 15. This numerical control system 15 may also control servomotors 16 and 17, which effect the motion of compound table 1 and therefore control the positioning of the grinding wheel in relation to the workpiece.

With the last discussed numerical control system the grinding process may be carried out fully automatically: in a first position of the workpiece and nominal profile carrier, the grinding wheel works a contour of the workpiece according to a prescribed program; then workpiece and nominal profile line are rotated in polar synchronism. Subsequent to this rotation the grinding wheel can work another area of the perimeter of the workpiece. In each phase, working progress can be observed on the projection screen. In this process the use of a single closed nominal profile line is sufficient, which may be retained during the entire working process. Rechucking the workpiece for different working areas is no longer necessary.

Working may of course also be carried out manually. For this purpose handwheels 18 are provided in a manner known in itself, with which compound table positioning motors 16 and 17 are actuated. In this case as well, after a segment of the perimeter is worked a desired area of the perimeter can be brought into the working position by appropriate synchronous rotation of the workpiece and the nominal profile line. This rotation can also be carried out manually if necessary. It is essential in this connection that rotation of the workpiece and the nominal profile line be executed in synchronism and at the same angular velocity, so that the angular relationship between workpiece and nominal profile line is strictly maintained throughout the entire working process.

In the embodiment illustrated in FIG. 1, the projector operates in the incident light mode.

Figure 2:
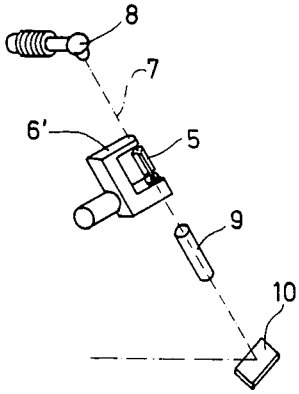

In FIG. 2 are illustrated parts of a mechanism that operates in the transmitted light mode. Parts corresponding to those in FIG. 1 bear the same reference numbers. Unlike the embodiment of FIG. 1, in which the workpiece is attached on one side to a rotating workpiece holder, in the embodiment of FIG. 2 the workpiece is supported in a manner permitting its rotation about the optical axis on the two legs of U-shaped workpiece holder 6'. Whereas in the embodiment shown in FIG. 1 the rotation of the workpiece about the projector's optical axis is effected by rotation of the workpiece holder, the workpiece holder in the embodiment shown in FIG. 2 is stationary and the workpiece rotates in the workpiece holder. The workpiece is roated in the workpiece holder in correspondence with the rotation of the nominal profile line by a suitable mechanism not represented in FIG. 2, for example, by appropriate rotational drive of a bearing-mounted shaft element in contact with the workpiece.

I claim:

1. An optical projection profile-grinding machine comprising:

means for holding a workpiece to be machined, means for rotating the workpiece and holding means about a first axis of rotation, means for grinding the new workpiece wherein said grinding means is positionable in relation to the workpiece, image projecting means including a projection screen wherein said projecting means displays an enlarged image of the point of engagement between said grinding means and the workpiece along an optical axis onto said projection screen, said first axis of rotation of the workpiece and holding means being coincident with said optical axis, and means for rotating said projection screen and said holding means and workpiece in synchronism and at the same angular velocity around said first axis and said optical axis.

2. A grinding machine as described in claim 1, wherein the rotational drive for the workpiece and the rotational drive for projection screen and its carrier are coupled by gearing.

3. A grinding machine as described in claim 1, wherein the rotational drives for workpiece and projector screen and its carrier contain servomotors which are actuated in synchronism by a numerical control system.

4. A grinding machine as described in claim 1 wherein said projection screen further comprises a carrier that accepts a nominal profile line and is arranged on said projection screen where it is rotatable about said optical axis of said projecting means.

* * * * *